US006962065B2

(12) United States Patent
Willmer

(10) Patent No.: US 6,962,065 B2
(45) Date of Patent: Nov. 8, 2005

(54) KNITTING MACHINE, IN PARTICULAR CIRCULAR KNITTING MACHINE, AND CONTROL JACK SUITABLE FOR SAME

(75) Inventor: Rolf Willmer, Albstadt (DE)

(73) Assignee: SIPRA Patententwicklungs- und Beteiligungsgesellschaft mbH, Albstadt (DE)

( * ) Notice: Subject to any disclaimer, the term of this patent is extended or adjusted under 35 U.S.C. 154(b) by 121 days.

(21) Appl. No.: 10/838,075

(22) Filed: May 3, 2004

(65) Prior Publication Data

US 2004/0221620 A1 Nov. 11, 2004

(30) Foreign Application Priority Data

May 9, 2003 (DE) ..... 103 21 737

(51) Int. Cl.[7] ..... D04B 15/16
(52) U.S. Cl. ..... 66/221; 66/219
(58) Field of Search ..... 66/215, 216, 217, 66/218, 219, 220, 221, 222–230, 116, 123

(56) References Cited

U.S. PATENT DOCUMENTS

| | | | | | |
|---|---|---|---|---|---|
| 3,861,173 | A | * | 1/1975 | Kinkelin | 66/220 |
| 4,559,791 | A | | 12/1985 | Schimko et al. | |
| 4,640,104 | A | * | 2/1987 | Dalmau Guell | 66/222 |
| 4,739,636 | A | * | 4/1988 | Manini | 66/220 |
| 4,905,484 | A | * | 3/1990 | Schindler | 66/220 |
| 5,076,074 | A | * | 12/1991 | Halamoda et al. | 66/90 |
| 5,174,131 | A | * | 12/1992 | Cottenceau et al. | 66/25 |
| 5,329,790 | A | * | 7/1994 | Engelfried et al. | 66/221 |
| 6,141,994 | A | * | 11/2000 | Plath | 66/219 |

FOREIGN PATENT DOCUMENTS

| | | |
|---|---|---|
| DE | 2 155 251 | 5/1973 |
| DE | 35 22 042 A1 | 2/1986 |
| DE | 37 12 673 C1 | 8/1988 |
| DE | 40 07 253 A1 | 9/1991 |
| DE | 42 17 419 C1 | 11/1993 |
| DE | 197 43 814 A1 | 4/1999 |
| EP | 0 138 696 B1 | 2/1990 |
| EP | 0 379 745 A1 | 8/1990 |
| EP | 0 545 485 A1 | 6/1993 |
| GB | 2 201 430 A | 9/1988 |

* cited by examiner

*Primary Examiner*—Danny Worrell
(74) *Attorney, Agent, or Firm*—Michael J. Striker

(57) ABSTRACT

What is described is a knitting machine with an electromagnetic selecting device for the three-way technique. In order to reduce the space requirement for the selecting device in height and width, assigned to each of the knitting tools (7) is a pivotable control jack (8) having two raising butts (17, 18) and to which, per selecting device, two control magnets (31, 32) arranged one after the other in the running direction of the knitting tools (7) are assigned. Depending upon which of the two control magnets (31, 32) is selected for a selecting procedure, the control jacks (8) find their way with one raising butt (17) onto a knitting cam (28) or with the other raising butt (18) onto a tuck cam (29).

12 Claims, 5 Drawing Sheets

KNITTING MACHINE, IN PARTICULAR CIRCULAR KNITTING MACHINE, AND CONTROL JACK SUITABLE FOR SAME

FIELD OF THE INVENTION

The invention relates to knifing machine comprising: at least one bed provided with grooves; knitting tools displaceably mounted in the grooves; control jacks displaceable and pivotable in the grooves and intended for their pretensioning, pretensioning springs, whereby the control jacks are allocated individually to the knitting tools and are designed as two-armed levers, each having a first and a second lever arm; at least one cam section movable relative to the bed with a pressure member intended for acting upon the control jacks, a knitting cam and a tuck cam beginning behind the kiting cam in the direction of movement; and at least one selecting device for controlling the control jacks with at least one first control magnet assigned to the knitting cam, one second control magnet assigned to the tuck cam and a holding magnet arranged between the two control magnets; whereby the arrangement is made such that on carrying out a relative movement between the bed and the cam, the first lever arms of the control jacks are initially guided to the first control magnet by the pressure member and against the force of the pretensioning springs and then optionally either held by said control magnet or released, in order to select the knitting tools assigned to the released control jacks for knitting, whilst the first lever arms of the firmly held control jacks are further firmly held by the holding magnets, guided to the second control magnet and then optionally either firmly held by it or released, in order to select the knitting tools assigned to the released control jacks for tuck and to select the knitting tools assigned to the firmly held control jacks for non-knitting.

BACKGROUND OF THE INVENTION

In a circular knitting machine of this type (DE 35 22 042 A1), for realising the three-way technique (stitch, tuck, no stitch), provided below the knitting tools are, on the one hand, intermediate push rods with spring elements projecting downwards from these and, on the other hand, control jacks arranged below the intermediate push rods, designed as two-armed levers. The control jacks may be actuated with the aid of selecting devices having a pressure cam, two control magnets and a holding magnet such that butts mounted on the spring elements may alternatively be guided along a knitting cam or a tuck cam, or past both these cams into a pass-through or no-stitch path. One advantage of this known selecting device consists therein that the control jacks do not take part in the driving-out movements of the knitting tools, intermediate push rods and spring elements and the two control magnets of each selecting device can therefore be arranged in the same plane perpendicular to the knitting tools, said plane being arranged in a circular knitting machine perpendicular to the axis of the needle cylinder. It is also advantageous that the control jacks constantly lie in an inactive position on the control magnets, i.e. while resting against them, they perform no driving-out movements, and that control jacks not released by the first control magnet are held by the holding magnet in a pivoted position, such that they do not have to be actuated again with a pressure cam before reaching the second control magnet.

The aforementioned advantages are obtained in the known circular knitting machine in that additionally arranged in each groove of the bed accommodating the knitting tools is an intermediate push rod, a spring element and a control jack, whereby the cam arrangement acting on these parts has a relatively large structural height. This is particularly undesirable for selecting devices for the dial needles of circular knitting machines in which the dial cam needs to be as short as possible in the radial direction, but also not advantageous for the control of the cylinder needles. Apart from this, three structural components additional to the knitting tools bring a high level of manufacturing effort and a reduction in operational reliability. Finally, the cam structure and the selecting devices of the known knitting machine lead to a relatively large breadth of the knitting systems measured in the movement direction of the bed or of the cam arrangement, since the selection to be undertaken with the second control magnet can only be carried out when the raising butts of the spring elements have been moved past the knitting cam and are arranged in an intermediate space between this and the tuck cam.

Similar problems arise in known knitting machines (DE 42 17 419 C1), whereby the control jacks comprise sliders displaceably mounted in pivotable pattern elements being coupled to push rods arranged beneath the knitting tools.

In another known knitting machine (DE 21 55 251 A1), the selection for stitch, tuck and no stitch is made in that pattern push rods arranged beneath the knitting tools are brought, with aid of two control magnets arranged at the same site, optionally into one of two possible pivot positions, or are held in a middle position. To this end, it is required to rotate the pattern butts with the aid of suitable pole surface out of their middle position, which may lead to pattern errors. Furthermore, the pattern push rods situated in the middle position are not forcibly guided in the region of the selecting site so that they could carry out unwanted rotation movements, due to vibration or similar, and thereby cause a breakage. Contrasted with the possible advantages of the contact of the pattern push rods against the control magnets in an inactive position, of the omission of the pressure cam members, a smaller number of components and a reduction in the structural height of the cam is the disadvantage of such low operational reliability, such that the selecting devices are unsuitable at least for small gauges (needle spacings) and high relative speeds between the bed and the cam.

Further, knitting machines are known (e.g. EP 0 138 696 B1) which, in place of the electromagnetic selection, provide mechanical selection. Arranged beneath the knitting tools here are intermediate push rods each having two raising butts and pivotably coupled to these, pattern jacks, which are pretensioned in the direction of a mechanical selecting device by means of pretensioning springs. The selecting devices are optionally provided with high, deep or no radially acting control cams in order to rotate the pattern jacks running past and with them the intermediate push rods into one of three possible pivot positions. By this means it is possible optionally to steer a lower ring butt onto a knitting cam or an upper raising bunt onto a tuck cam of a cam arrangement, or to pivot both butts out of the region of these cam curves, in order that allocated knitting tools pass through a no stitch path. Contrasted with the disadvantage of the limited pattern possibilities, which permit no individual selection of knitting tools and also of the relatively large structural height of the cam in this knitting machine, is the advantage that the knitting and tuck cams may lie directly one over the other and therefore the width of a knitting system depends substantially only upon the width of the cam curves needed to pivot the pattern jacks. Direct transfer of this technology to electromagnetic selecting devices would change little in relation to the stated disadvantages.

Finally, knitting machines are known with selecting devices (DE 197 43 814 A1), which are intended for pivoting control jacks and have a first control magnet permitting selection between raising and run-through (non knitting), and a second control magnet permitting selection between tuck and stitch. However, the second control magnets must either be arranged at a height corresponding to the tuck height of the control jacks, or the control jacks must have a length such that, even after raising into the tuck position, their anchor surfaces which interact with the control magnets are still situated in the actuating region of the second control magnet lying in the same plane as the first control magnet. Both designs are associated with an undesirable increase in the structural height. Furthermore, the control jacks are guided here to the control magnets in an active position such that they are driven out in conditions where they contact the control magnets, which is undesirable for avoiding premature wear of the magnet pole surfaces. Finally, for ensuring a free-moving rotation of the control jacks from the tuck position, it would be necessary to provide special measures (e.g. DE 40 07 253 A1), which is also not always desirable.

BACKGROUND OF THE INVENTION

Starting from this prior art it is an object of this invention to so design the knitting machine of the kind specified above that it largely encompasses the aforementioned advantages.

A further object underlying this invention is to so design the knitting machine of the aforementioned type that the disadvantages mentioned above are substantially avoided.

According to yet another object the knitting machine according to this invention should have electromagnetic patterning means according to the three-way technique as well as a cam arrangement of low structural height, a small system width and few components.

According to yet another object of the invention the electromagnetic pattering means should enable contact of its control magnets with the control jacks in inactive conditions.

Finally, it is also an object underlying this invention to suggest a control jack suitable for knitting machine of this invention.

These and other objects of this invention are solved by the knitting machine of the kind specified above and being characterized in that the second lever arms of the control jacks are each provided with a lower raising butt intended for running onto the knitting cam and an upper raising butt intended for running onto the tuck cam.

The invention brings with it the advantages that due to the use of two butts per control jack, despite a side-by-side or one-behind-the-other arrangement of the control magnets, a relatively small width is achieved for the selecting devices. Since, furthermore, the control jack itself, and not a part interacting with it, is provided with a raising butt, no additional components are needed, which has a favourable effect on the strut height of the cam arrangement. Furthermore, the control jacks always lie against the control and holding magnets in the inactive conditions only.

Further advantageous features of the invention are contained in the subclaims.

BRIEF DESCRIPTION OF THE DRAWINGS

The invention will now be described in greater detail using an example with the aid of the accompanying drawings, in which.

DETAILED DESCRIPTION OF A PREFERRED EMBODIMENT OF THE INVENTION

Figure 1:
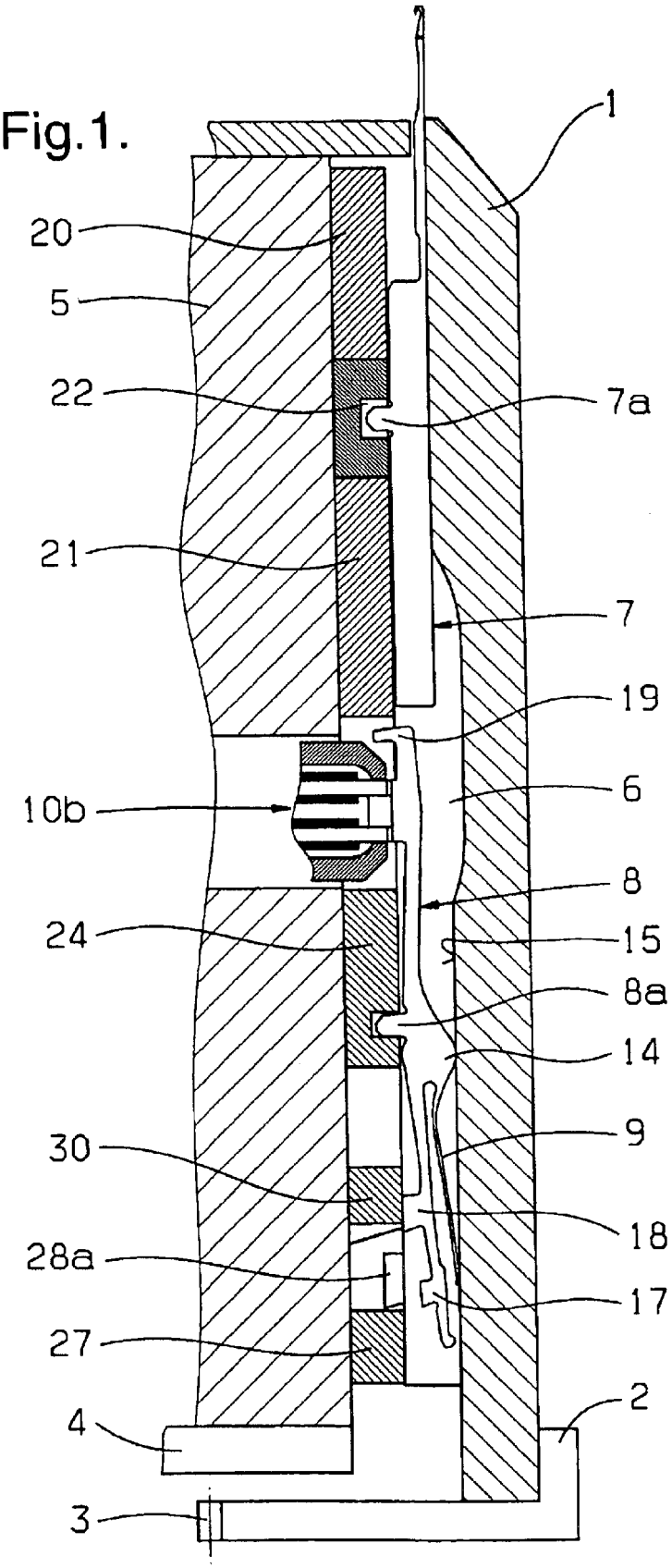
FIG. 1 shows a schematic vertical section through a circular knitting machine according to the invention approximately through the line I—I in FIG. 2.

FIG. 1 shows a circular knitting machine with a bed 1 in the form of a typical needle cylinder attached to a carrier ring 2. This is rotatably mounted in a machine chassis (not shown) and provided with an outer toothed rim 3, which is linked to a drive gear wheel (not shown) drivable by a drive motor. Mounted on a cam plate statically borne on a machine chassis is a carrier ring 4 to which a cam is attached having a cam carrier 5 surrounding a needle cylinder, said cam carrier carrying on its inside a plurality of cam sections 5*a*, 5*b* (FIG. 2) arranged in the circumferential direction of the bed 1 adjacent to each other and forming knitting systems.

The bed 1 has a plurality of grooves formed by webs 6, said grooves arranged here parallel to the rotation axis of the bed 1 or needle cylinder and accommodating knitting tools 7, formed here, for instance, as typical latch needles. Assigned to each knitting tool 7 is a control jack 8 arranged beneath it and in the same groove of the bed 1. In the example, the knitting tools 7 are arranged displaceable in the grooves parallel to the rotation axis whilst the control jacks 8 are mounted displaceable parallel to the rotation axis and pivotable radially to it in the grooves.

The knitting tools 7 and control jacks 8 have, in particular for their drawing down, butts 7*a* and 8*a*, to which are assigned drawing down members of the cam, as described below. The control jacks 8 are also provided with pretensioning springs 9 attached to them or made in one piece with them and by means of which they are pretensioned in the radial direction.

Figure 2:
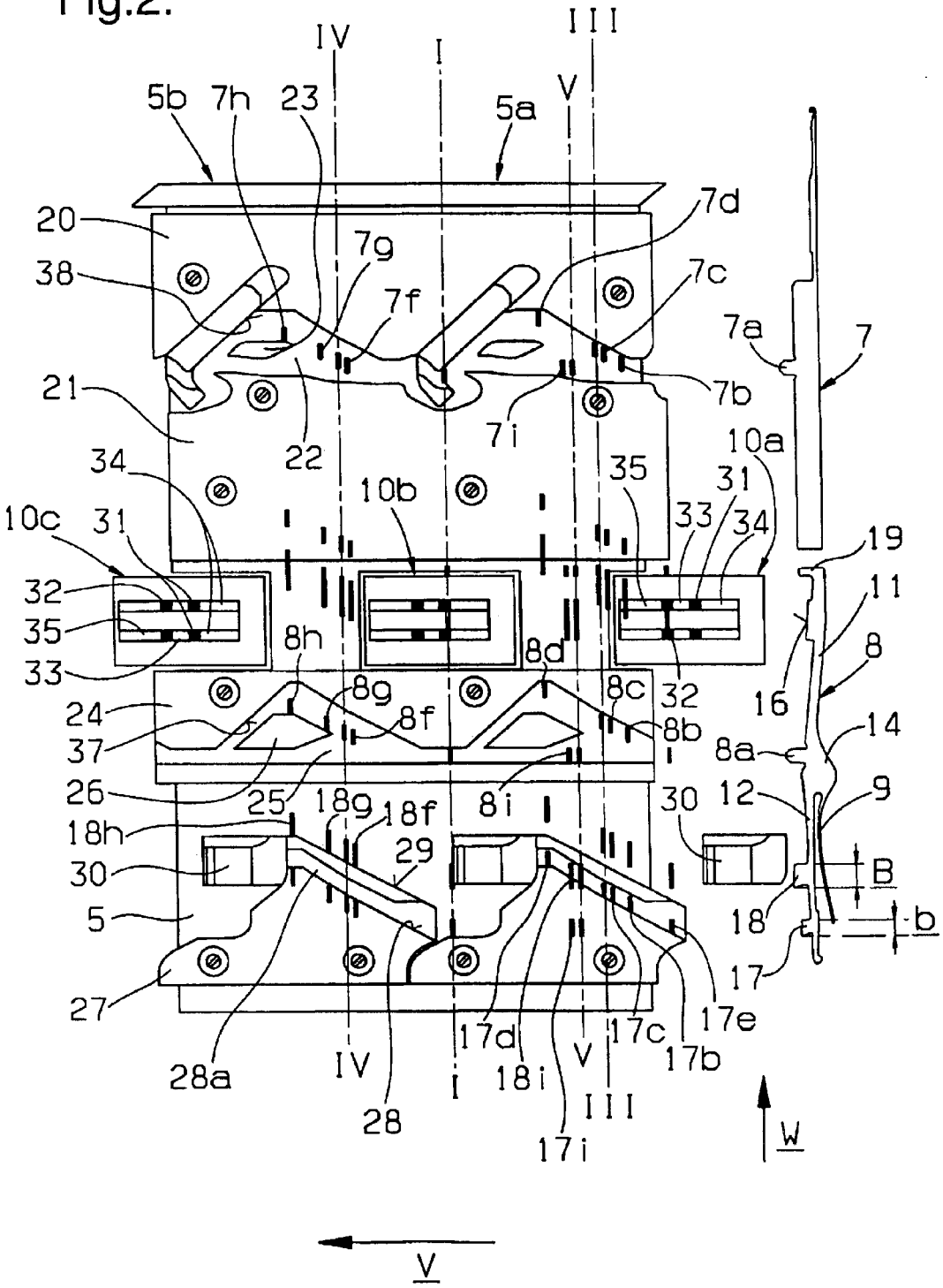
FIG. 2 shows a schematic view from inside of a cam arrangement of the circular knitting machine according to FIG. 1.

As FIG. 2 in particular shows, assigned to each cam section 5*a*, 5*b* is a selecting device 10*a*, 10*b*, which serves the purpose of allowing the knitting tools 7 to run through, optionally, a stitch, tuck, no stitch or pass-through path when executing relative move-merits between the bed 1 and the cam carrier 5.

Circular knitting machines of this type are generally known, for instance, from the documents DE 35 22 042 A1, DE 37 12 673 C1 and DE 40 07 253 C2 which, in order to avoid repetition, are hereby incorporated into the subject matter of the present disclosure by reference.

Figure 3:
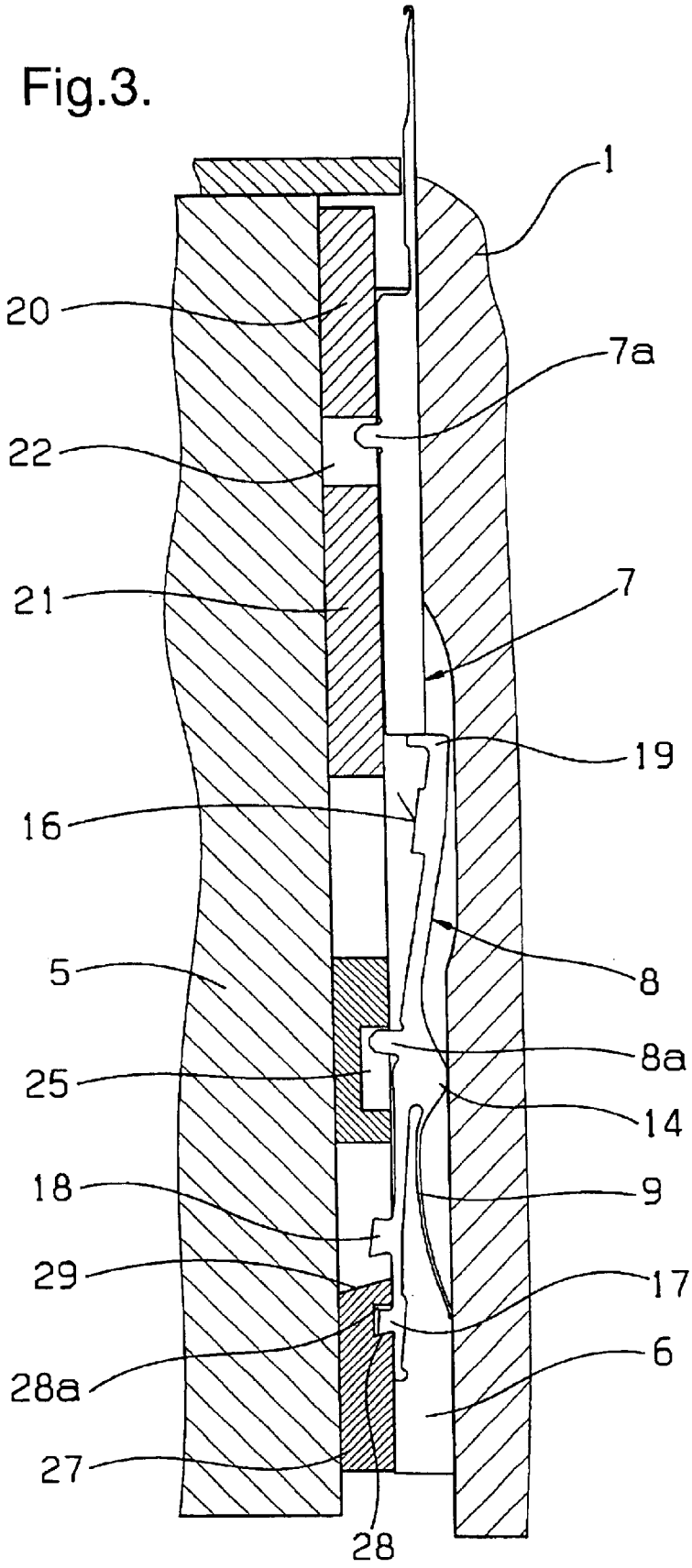
FIGS. 3 to 5 show sections corresponding to that in FIG. 1 according to the respective lines III—III to V—V of FIG. 2.

According to the invention, the control jacks 8 comprise, as FIGS. 1 and 2 show, two-armed levers having first lever arms 11 and second lever arms 12. Provided between the lever arms 11 and 12 are rounded bearing sites 14 by means of which the control jacks 8 are supported on the bases 15 (FIG. 1) of the grooves of the bed 1. The arrangement in the example is such that the first lever arm 11 is provided with an anchor surface 16 (FIG. 2) facing radially outwards. The butt 8*a* lies approximately at the height of the bearing site 14 and the second lever arm 12 has two raising butts 17 and 18 arranged one over the other, which extend radially outwards like the butt 8*a*. At an upper end of the control jack 8 is also formed a support butt 19 which interacts with the knitting tool 7 arranged above it. The pretensioning spring 9 is on a rear side of the control jack 8 facing towards the base 15 of the associated groove and so arranged that the control jack 8 may assume two preferred radial pivot positions. With the pretensioning spring 9 substantially relaxed, the control jack 8 is pivoted about the bearing site 14 such that its upper first lever arm 11 lies against the base 15 of the associated groove and therefore the anchor surface 16 is withdrawn into the groove as, for ice, FIG. 3 shows whilst, simultaneously the lower, second lever arm 12 is pretensioned outwards by the pretensioning spring 9 supported on the base 15 of the groove, so that the raising butts 17, 18 extend outwards from the groove. Conversely in the other preferred pivot position, on the other hand, as FIG. 1 shows, the first lever arm 11 is pivoted outwards and the second lever arm 12 is pivoted inwards under the tension of the pretensioning spring 9, so that the anchor surface 16 extends radially outwards from the groove and the raising butts 17, 18 are withdrawn into the relevant groove. Corresponding positions may be assumed by all the control jacks 8 provided.

The control jacks 8 described including the butts 8*a*, 17 and 18, as well as the pretensioning springs 9 are preferably manufactured in one piece.

The cam sections 5*a*, 5*b* visible in particular in FIG. 2 are substantially identically made. For simplification of the representation, the left-hand cam section 5*b* is overwhelmingly provided with the reference numbers identifying the cam members and the right-hand cam section 5*a* is overwhelmingly provided with reference numbers identifying various butts of the knitting tools 7 and control jacks 8.

According to FIG. 2, two cam members 20, 21 lying one above the other are allocated to the butts 7*a* of the knitting tools 7 in each cam member or system 5*a*, 5*b*, leaving a recess 22 between them which is provided in a middle region with a separating cam member 23. Arranged in a region of the cam sections 5*a*, 5*b* lying beneath the cam member 21 is, respectively, one of the selecting devices 10*a*, 10*b*, which are aged at the entry to the respective cam section 5*a*, 5*b*. The "entry" is understood here to be the beginning of the relevant cam section 5*a*, 5*b* first reached by the knitting tools 7 and control jacks 8 when these move relative to the cam in the direction of an arrow V (FIG. 2). Furthermore, directly beneath the selecting devices 10*a*, 10*b*, the cam sections 5*a*, 5*b* have a cam member 24 allocated to the butts 8*a* of the control jacks 8, said cam member being provided, similarly to the cam members 20, 21, with a recess 25 and a separating cam member 26. Finally, beneath the cam members 24, there is also a cam member 27 assigned in each case to the raising butts 17, 18 of the control jacks 8. This member has knitting cam 28 and a tuck cam 29. The knitting cam 28 comprises a side edge of a groove 28*a* set into the cam member 27 from the inner surface facing towards the butts 17, 18. It serves to interact with the lower raising butts 17 and raises the raising butts 17 running into it into a stitch position. The tuck cam 29, by contrast, comprises an outer edge of the cam member 27 substantially parallel to the knitting cam 28. The tuck cam 29 serves to interact with the upper raising butts 18 and raises the raising butts 18 running into it as far as a tuck position. The knitting cam 28 and the tuck cam 29 preferably lie at least partially over one another.

In order that the same pivot positions of the control jacks 8 should be obtained at all the entries to the cam sections 5*a*, 5*b*, before the entry to each cam section 5*a*, 5*b*, a pressure member 30 also visible in FIG. 1 is provided, which acts in a radial direction from outside towards the inside onto the upper raising butts 18 and pivots all the passing control jacks 8 independently of their behaviour in the previous system section into a position in which the lower lever arm 12 is pivoted back into the relevant groove of the bed 1 (FIG. 1).

The selecting devices 10*a* and 10*b* and a third selecting device 10*c* shown in FIG. 2 each contain, according to FIG. 2, two control magnets 31, 32 arranged one after another in the running direction (arrow V) of the knitting tools 7 and a holding magnet 33 connecting the pole faces of the two control magnets 31, 32 flush with each other. Arranged before the first control magnet 31 is preferably a fiber holding magnet 34. Finally, each selecting device 10*a, b, c* also has a third holding magnet 35 arranged behind the second control magnet 32 in the running direction.

Furthermore, the various cam members and selecting devices in FIG. 2 are so disposed and arranged relative to one another that the circular knitting machine functions in the following manner.

It is assumed that the bed or the needle cylinder 1 is brought into rotation such that the knitting tools 7 and control jacks 8 mowed in its grooves are moved traverse to the rotation axis in the direction of the arrow V in FIG. 2. When a control jack 8 enters the system section 5*a*, it firstly enters the region of action of the pressure cam 30 which, according to FIG. 1, presses against its upper raising butt 18 such that said butt is pivoted radially into the associated groove of the bed 1 and simultaneously the anchor surface 16 reaches the first holding magnet 34 of the selecting device 10*a*, as is shown in FIG. 1 for the selecting device 10*b*. On further transport, the control jack 8 is held in this pivoted position until its anchor surface 16 reaches the first control magnet 31.

If the control magnet 31 is controlled such that it does not attract the anchor surface 16 but leaves free or releases the control jack 8, then the control jack is pivoted under the influence of the pretensioning spring 9 about the bearing site 14 such that its raising butts 17, 18 mounted on the second lever arm 12 are moved radially outwards and emerge radially from the relevant groove of the bed 1. On further transport in the direction of the arrow V, they then pass into the region of action of the knitting cam 28, since this, seen in the direction of the arrow V, begins somewhat earlier than the tuck cam 29. As a result, the lower raising butt 17 runs into the knitting cam 28 (FIG. 3), so that the associated control jack 8 is driven out perpendicular to the arrow V and parallel to the rotation axis of the needle cylinder (arrow W in FIG. 2). Its support butt 19 is thereby laid against the lower edge of the associated knitting tool 7, so that this is also driven out in the direction of the arrow W. The knitting cam 28 is designed in the direction of the arrow V, and has a length such that initially the buns 8*a* of the control jacks 8 enter the recess 25 of the cam member 24 and are then lifted over tile separating cam member 26, whilst shortly thereafter the butts 7*a* of the knitting tools 7 are introduced into the recess 22 and are then lifted over the separating cam member 23. Finally, the knitting tool 7 is lifted into its highest position corresponding to the knitting position. This is indicated in FIG. 2 width the butt positions 17*b*, 17*c*, 17*d* and 5*b*, 8*c*, 8*d* and 7*b*, 7*c*, 7*d* representing a checked pattern.

If, by contrast, the first control magnet 31 is controlled such that it attracts the anchor surface 16 again, then this reaches the following holding magnet 33 so that the control jack 8 remains in the pivoted position shown in FIG. 1 and is guided in this pivoted position to the second control magnet 32.

If the second control magnet 32 is controlled at this time point such that it does not attract the anchor surface 16 but releases the control jack 8, then the control jack is pivoted under the influence of the pretensioning spring 9 about the bearing site 14 such that its raising butts 17, 18 mounted on the second lever arm 12 are pivoted radially outwards. However, since its lower pushing-out butt 17, as indicated in FIG. 2 with a butt 17*e*, in this position has just passed the frontmost rising member of the knitting cam 28, this raising butt 17 is laid against an inner surface 36 (FIG. 4) facing towards it of the can member 27 without mini into the knitting cam 28 or entering the relevant groove 28*a* of the cam member 27.

Instead, during the further progress, the raising butt 18 of this control jack 8 comes into the region of action of die tuck cam 29, which begins shortly behind the knitting cam 28. The tuck cam 29 therefore lifts the raising butt 18 as far as into a tuck position, which has the consequence that the support butt 19 of the relevant control jack 8 also raises the associated knitting tool 7 out into a tuck position, whereby the butts 8*a* and 7*a* are lifted, as in the initially described case, over the divider tips of the separating cam members 26 and 23. This is indicated in FIG. 2 with the butt positions 18*f*, 18*g*, 18*h* and 8*f*, 8*g*, 8*h* and 7*f*, 7*g*, 7*h*.

If, on the other hand, the second control magnet 32 is controlled such that it also continues to attract the anchor surface 16, then said anchor surface reaches the following holding magnet 35, so that the control jack 8 here also remains in a pivot position visible from FIG. 1 and is moved in this pivot position past the tuck cam 29 (FIG. 5) without being lifted by it until it lies safely behind the inner surface 36. Control jacks 8 controlled in this manner are therefore not raised, but run through a no stitch path, as indicated in FIG. 2 by the butt positions 17*i*, 18*i*, 8*i* and 7*i*. The butts 8*a* and 7*a* are then moved beneath the separating cam members 26, 23 in order to ensure a reliable separation of the driven-out control jacks 8 and the knitting tools 7.

After completed sorting of the knitting tools 7 into stitch, tuck and no stitch positions, all the control jacks 8 are drawn down again by a draw-down cam 37 acting on their butts 8*a* and all the knitting tools 7 are drawn down by a drawn-down cam 38 acting on their butts 7*a*, into their starting position according to FIG. 1, so that in the subsequent cam section or system, a new selecting process may begin.

In the selecting device described, the two control magnets 31, 32 may lie both close together as well as in the same plane perpendicular to the knitting tools 7 or to the effective rotation axis of the needle cylinder. The latter applies particularly because, on reaching the second control magnet 32, the control jacks 8 may be in a not yet raised position (FIG. 2). Due to the presence of the two raising butts 17, 18 per control jack 8, the selection to be undertaken with the second control magnet 32 may take place when the lower raising butt 17 has just been covered up, as in FIG. 4, by the inner surface 36 of the cam member 27 and can no longer run onto the knitting cam 28. The knitting and tuck cams 28 and 29 may therefore preferably be arranged, as in FIG. 2, so close to each other or over each other, i.e. interleaved with each other, that the muck cam 29, seen in the direction of the arrow V, begins only a little later than the knitting cam 28. As a consequence, the entire selection devices may be designed relatively narrow in the direction of the arrow V and the number of systems able to be accommodated on the periphery of a circular knitting machine may be significantly increased. Furthermore, the height of the associated cam section 5*a* or 5*b* may be designed relatively small in the direction of the arrow W due to the use of only one control jack 8, which significantly reduces the space requirement of the cam.

Figure 4:
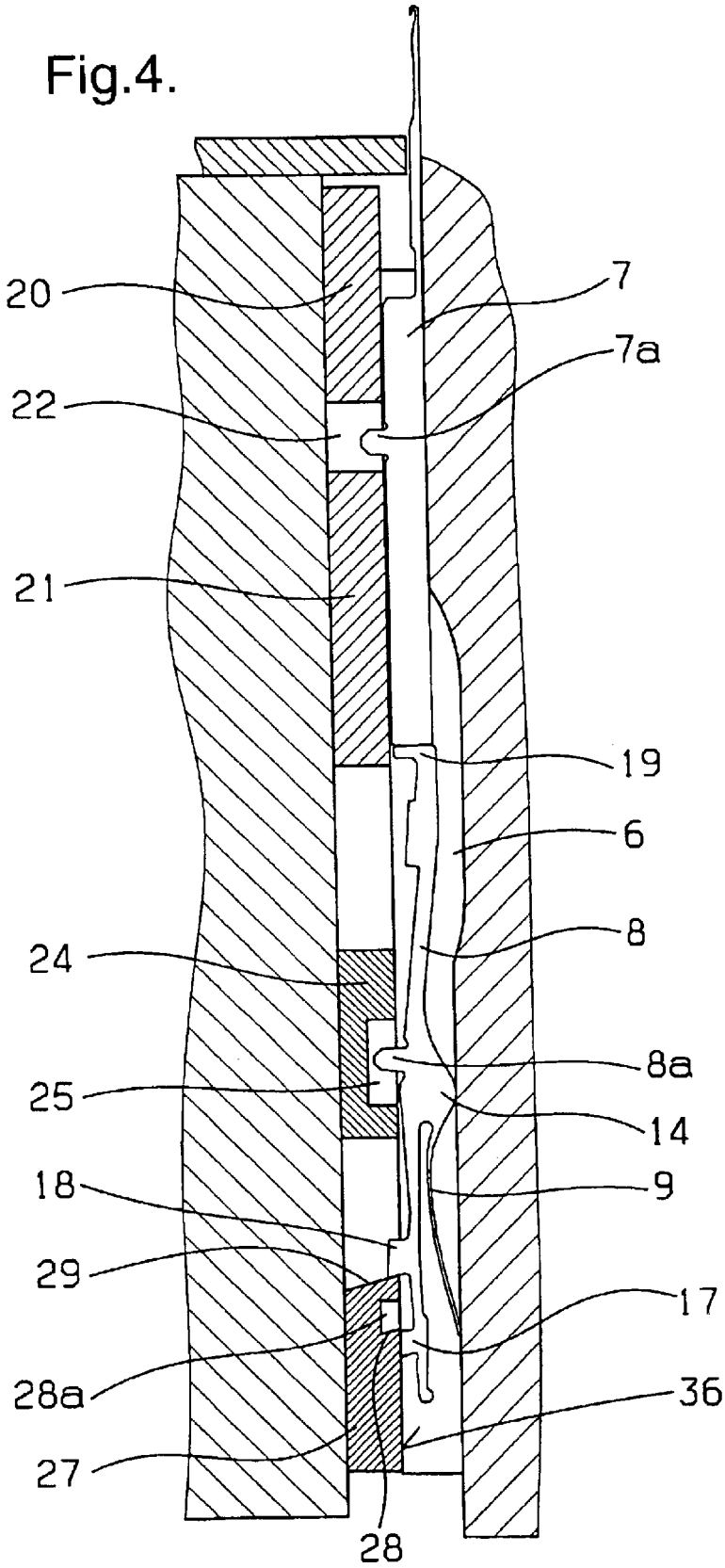

In order to ensure that the upper raising butt 18 is always held by the tuck cam 29 even if the lower raising butt 17 lies against the inner surface 36 of the cam member 27 (FIG. 4), its radial height measured perpendicular to the longitudinal axis of the control jack 8 or in the direction of the arrow V is preferably correspondingly greater than the height of the lower raising butt 17 (FIGS. 2 and 4) measured in the same direction. The upper raising butt 18 then projects radially by so much above the lower raising butt 17 that it also reliably overlaps the tuck cam 29 when the lower raising butt 17 lies against the inner surface 36 (FIG. 4).

The separation of the two raising butts 17 and 18 from each other measured parallel to the longitudinal axis of the control jacks 8 or in the direction of the arrow W is preferably greater than that which represents the largest separation of the knitting and tuck cams 28, 29 in this direction. This ensures that during running of the upper raising butt 18 into the tuck cam 29, under no circumstances can the lower raising butt 17 simultaneously run into the knitting cam 28 and thereby prevent raising into the tuck position.

Figure 5:
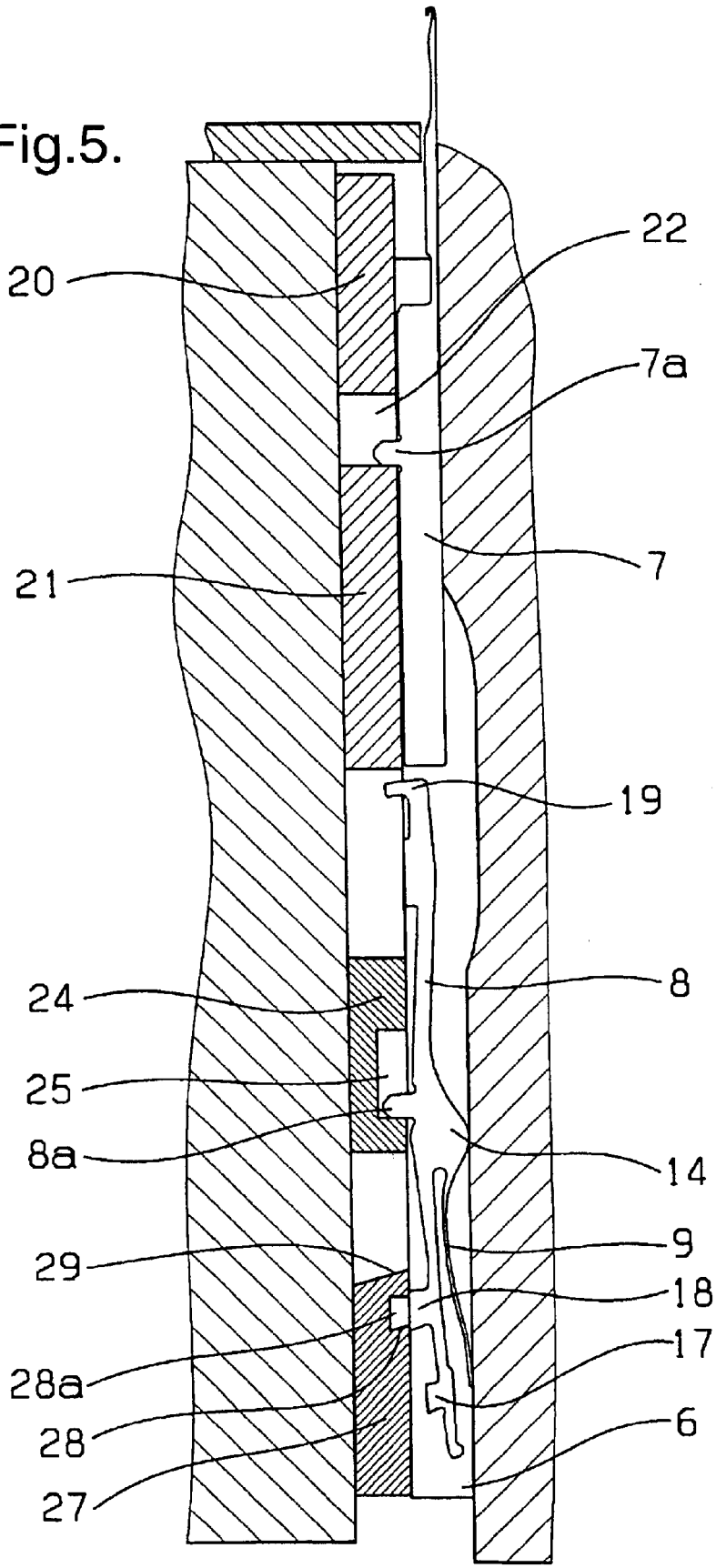

According to a particularly preferred embodiment of the invention deemed to be the best one up to now, the width a of the upper raising butt 18 measured in the direction of the longitudinal axis of the control jacks 8 or in FIG. 2 parallel to the arrow W is greater than the correspondingly measured width b of the other raising butt 17. In particular, the raising butt 18 is at least exactly as wide or wider than the greatest width of the groove 28*a* measured parallel to the arrow W. This measure serves the purpose of preventing entry of the upper raising butt 18 into the groove 28*a* or running into the knitting cam 28 in every imaginable operating condition (FIG. 5). By this means, it is ensured in particular that the upper raising butt 18 of a control jack 8, if selected for the non-knit position, cannot unintentionally reach the knitting cam 28 even when it is just passing the groove 28*a*, but is held away from it (FIG. 5) by its greater width B. Therefore no additional measures are required in order to fulfil the aim.

Otherwise it is clear that the invention encompasses not only the knitting machine described, but the selecting device itself and the control jack 8 designed according to the invention.

The invention is not limited to the example described, which may be adapted in many ways. For instance, it is conceivable that the pressure member 30 could be made to act upon another section of the control jack 8 than the upper raising butt 18. The anchor surface 16 does not have to represent a separate part of the control jack 8, since the entire front end face of the first lever arm 11 facing towards the selecting device is usable as an anchor surface 16. Furthermore, the selecting devices and in particular the control and holding magnets 31 to 35 may be designed differently, as schematically represented in FIG. 2. As is per se well known, the control and holding magnets may optionally be designed as pure electromagnets, pure permanent magnets or combinations thereof and equipped with suitable pole surfaces comprising hardened materials for the anchor surfaces 16. The cam members 27 and the cams 28, 29 formed on them may also be designed differently than described, in particular also in multiple parts, even if the single-part design is most highly regarded due to its small space requirement and low production and assembly costs. Otherwise, die invention is also not restricted to the circular knitting machine described purely by way of example and to the application of knitting tools in the form of latch needles, but also to other knitting machines, in particular circular knitting machines with stationary needle cylinders and rotatable cams or flat bed knitting machines and to other knitting tools such as, for instance, plates selectable according to pattern, or plush hooks. Finally, it is self-evident that the different features may also be utilised in other combinations than those described and illustrated.

It will be understood, that each of the elements described above or two or more together, may also find a useful application in other types of construction differing from the types described above.

While the invention has been illustrated and described as embodied in a circular knitting machine, it is not intended to be limited to the details shown, since various modifications and structural changes may be made without departing in any way from the spirit of the present invention.

Without further analysis, the forgoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. Knitting machine comprising: at least one bed (1) provided with grooves; knitting tools (7) displaceably mounted in said grooves; control jacks (8) displaceable and pivotable in said grooves and, intended for their pretensioning, pretensioning springs (9), said control jacks (8) being allocated individually to said knitting tools (7) and being designed as two-armed levers, each lever having a first and a second lever arm (11, 12); at least one cam section **(5*a*, 5*b*) movable relative to said bed (1) and having a pressure member (30) intended for acting upon said control jacks (8), a knitting cam (28) and a tuck cam (29) beginning behind said knitting cam (28) in a direction of said relative motion; and at least one selecting device for controlling said control jacks (8) with at least one first control magnet (31) assigned to said knitting cam (28), one second control magnet (32) assigned to said tuck cam (29) and a holding magnet (33) arranged between said two control magnets (31, 32); wherein an arrangement is made such that on carrying out a relative movement between said bed (1) and said cam, said first lever arms (11) of said control jacks (8) are initially guided to said first control magnet (31) by said pressure member (30) and against a force of said pretensioning springs (9) and then are optionally either held by said first control magnet or released, in order to select knitting tools (7) assigned to control jacks (8) released from said first control magnet for knitting, whilst first lever arms (11) of firmly held control jacks (8) are further firmly held by said holding magnets (33), guided to said second control magnet (32) and are then optionally either firmly held by it or released, in order to select knitting tools (7) assigned to control jacks (8) released from said second control magnet for tuck and to select knitting tools (7) assigned to firmly held control jacks (8) for non knitting; wherein said second lever arms (12) of said control jacks (9) are each provided with a lower raising butt (17) intended for running onto said knitting cam (28) and an upper raising butt (18) intended for running onto said tuck cam (29)**.

2. Knitting machine according to claim 1, wherein said upper butt (18) is higher than said lower butt (17).

3. Knitting machine according to claim 1, and being provided with means for preventing said upper raising butt (18) from running onto said knitting cam (28).

4. Knitting machine according to claim 1, wherein said tuck cam (29) lies at least partially over said knitting cam (28) and is separated from it by a groove **(28*a*)**.

5. Knitting machine according to clam 1, and having means such that said upper raising butts (18) have a greater width (B) than said groove **(28*a*) and said lower raising butts (17)**.

6. Knitting machine according to claim 1, characterised in that said control jacks (8) are provided with bearing sites (14) supportable on bass of said grooves and arranged between said two lever arms (11, 12).

7. Knitting machine according to claim 4, wherein said upper and lower raising butts (17, 18) of said control jacks (8) are greater than largest spacings between aid hitting cam (28) and of said tuck cam (29) lying one over the other.

8. Knitting machine according to claim 4, wherein said knitting cam (28) and said tuck cam (29) are formed from a common cam member (27).

9. Knitting machine according to claim 4, wherein said knitting cam (28) is formed by a groove **(28*a*) and said tuck cam (29) is formed by an outer edge of one and a same cam member (27)**.

10. Knitting machine according to claim 1, wherein said two control magnets (31, 32) lie substantially in a common plane disposed perpendicular to said control jacks (8).

11. Knitting machine according to claim 1, wherein said pressure cam (30) is adjusted for acting on said upper raising butts (18) of said control jacks (8).

12. Control jack for a knitting machine and being designed according to claim 1.

* * * * *